US005429056A

United States Patent [19]

Pees et al.

[11] Patent Number: 5,429,056

[45] Date of Patent: Jul. 4, 1995

[54] METHOD OF OPERATING A BOGIE USING ACTUATORS FOR WHEEL STEERING

[75] Inventors: Ernst Pees, Altenholz; Hans-Dieter Schaller, Kiel, both of Germany

[73] Assignee: Krupp Verkehrstechnik GmbH, Germany

[21] Appl. No.: 157,943

[22] Filed: Nov. 23, 1993

[30] Foreign Application Priority Data

Nov. 28, 1992 [DE] Germany ..... 42 40 098.8

[51] Int. Cl.[6] ..... B61F 5/38

[52] U.S. Cl. ..... 105/168; 105/176

[58] Field of Search ..... 105/168, 176, 218.2

[56] References Cited

U.S. PATENT DOCUMENTS 4,175,494 11/1979 Moser ..... 105/168 X
4,289,075 9/1981 Smith ..... 105/168 X
4,519,329 5/1985 Vacher ..... 105/168
4,970,384 11/1990 Kambe et al. ..... 250/221
4,982,671 1/1991 Chollet et al. ..... 105/168

FOREIGN PATENT DOCUMENTS 293253 12/1990 Japan ..... 105/168

*Primary Examiner*—Robert J. Oberleitner
*Assistant Examiner*—S. Joseph Morano
*Attorney, Agent, or Firm*—Thomas N. Ljungman

[57] ABSTRACT

On undercarriages for railway vehicles with at least four wheelsets which are combined into trucks, the invention teaches that force-controlled or displacement-controlled actuators are located on the end wheelsets of the trucks. These actuators thereby act on the wheelset bearings, and in terms of their effect, they are connected in parallel, in the case of the force-controlled actuators, and in series, in the case of the displacement-controlled actuator with a wheelset restraint. This system makes possible a controlled rotation of the wheelset in relation to the truck frame.

6 Claims, 9 Drawing Sheets

METHOD OF OPERATING A BOGIE USING ACTUATORS FOR WHEEL STEERING

BACKGROUND OF THE INVENTION

1. Field of the Invention

This invention relates to an undercarriage for railway vehicles with at least four wheelsets, or pairs of wheels, and with at least two wheelsets respectively combined into a truck, and connected to a truck frame by means of coupling and guide elements. Such a truck frame can generally be oriented so that it can pivot in relation to a vehicle frame.

2. Background Information

Essentially two types of problems must generally be taken into consideration in designing undercarriages of this type. These problems are:

stable running on straight sections of track throughout the entire range of speeds, and low-wear running in curves.

Known are undercarriages which use a rigid longitudinal guidance of the wheelsets to prevent self-excited vibrations and to guarantee a secure transmission of propulsion and braking forces. On account of the large restoring forces which are applied by such longitudinal guidance to counter the rotation of the wheelsets, these wheelsets essentially cannot be completely radially controlled in curves. The remaining off-track running tends to induce a lateral force directed outward on the leading wheelset of the truck, and a force directed toward the center of the curve on the trailing wheelset. As a result of the momentum effect, the truck is controlled anti-radially. This is designated as "sideways running" or "rear free running". This behavior in curves results in large friction forces between wheel and rail, and in correspondingly high wear.

By selecting lower rigidities in the wheelset longitudinal guides, of course, the running behavior in curves can be improved, but such reduced rigidities also adversely affect stability when the vehicle is running on straight sections of track. The demand for low wear during negotiation of curves and sufficient stability when running on straight sections of track therefore generally requires a compromise with regard to the longitudinal restraint of the wheelset.

Also known are undercarriages which have two opposite wheelsets coupled to one another by means of a mechanical coupling device, and on which the wheel profile and longitudinal restraint of the wheelset is designed so that the elastic restoring forces which counteract the rotation of the wheelsets on the truck frame are less than the longitudinal forces generated by the conicity of the running surface of the wheels. Such cross-coupled running gear mechanisms have the disadvantage that, on account of the low longitudinal rigidity of the wheelset guides, additional connecting rods are required to transmit traction and braking forces. Special wheel profiles are also required.

Other designs have attempted to combine good running in curves and high stability by converting the rotational movement between the truck frame and the vehicle frame by means of levers into a radial adjustment of the wheelsets. Because the angle of rotation of the two trucks is generally different, the leading truck tends to be set for too large a radius of curvature, while the trailing truck tends to be oversteered. In addition to this disadvantage, an additional unfavorable characteristic of such designs is the complexity of the mechanical coupling elements, such as levers and joints, which can become lost, fall off, or become worn.

Improvements are possible with the use of elastomer elements as joints. But these joints tend to have greater elastic play, and therefore perform the transmission function only to a limited extent. The couplings between the vehicle frees and the wheelsets can also have a negative effect on stability when the vehicle is running on straight sections of track.

OBJECT OF THE INVENTION

The object of the invention is to create an undercarriage of the type described above for railway vehicles, which, with relatively simple mechanical coupling devices:

guarantees a radial adjustment capability for the wheelsets when the train is negotiating curves;

reduces wear to a minimum and thus guarantees good transmission of traction force in curves; and does not adversely affect stability when the vehicle is running in straight sections.

SUMMARY OF THE INVENTION

The present invention teaches that the problems discussed hereinabove can be solved if force-controlled actuators such as bellows cylinders are connected to at least the end wheelsets of the trucks, and act on the wheelset bearings for the radial rotation of the wheelset in relation to the truck frame, and if the actuators are oriented parallel to longitudinal control arms with an assembly of mutually opposing springs for the longitudinal restraint of the wheelset.

Alternatively, the invention teaches that there can be displacement-controlled actuators such as regulating motors to adjust a spindle by means of a driven nut connected to the end wheelsets of the trucks, which act on the wheelset bearings for the radial rotation of the wheelset in relation to the truck frame, and that the actuators are installed in line, that is, in series, with longitudinal control arms for the longitudinal restraint of the wheelset.

With these configurations, it is possible, when the vehicle is negotiating a curve, by activating the actuators to an extent corresponding to the radius of the curve, to spread the end wheelsets of the truck into the radial position, without thereby generating restoring forces on the wheelsets, on the vehicle frame or on the truck frame. The radial position of the wheelsets results in a low level of wear and uniform wear on all the wheels. On account of the almost identical coefficient of adhesion at all contact points of the wheel, a better utilization of traction and braking forces can be achieved in curves, without skidding, slipping or locking of the wheels.

Since there is essentially no mechanical coupling between the rotational movement of the wheelsets and the rotational movement of the truck frame, the striking angle of the wheelsets can be set as necessary to the value required for the transmission of centrifugal forces.

The absence of undesirable couplings and the fact that a rigid longitudinal restraint of the wheelset has been selected guarantee a high stability during negotiation of curves and during travel on straight sections of track.

One advantageous configuration of the invention can be achieved if a sensor is located as the measurement element between the vehicle frame and the truck frame, and the actuators can be adjusted as a function of the angle of rotation measured by the sensor.

The invention also teaches that a sensor can be located on each truck frame, and the actuators can all be adjusted jointly as a function of the average value of the two angles of rotation by means of a control device. The particular advantage of this arrangement is that the curve being negotiated can be determined with great accuracy from an average angle of rotation.

In summary, one aspect of the invention resides broadly in a railroad bogie for being mounted on a railroad car, the railroad car having a frame and defining a longitudinal direction, the railroad bogie comprising: a frame element; means for pivotally connecting the frame element to the frame of the railroad car; a first wheelset being mounted on the frame element; a second wheelset being mounted on the frame element; the first wheelset comprising a first axle, the first axle comprising opposite ends; the first wheelset comprising a pair of wheels being mounted at the opposite ends of the first axle; means for permitting pivotal movement of the first axle with respect to the frame element; the second wheelset comprising a second axle, the second axle comprising opposite ends; the second wheelset comprising a pair of wheels being mounted at the opposite ends of the second axle; means for permitting pivotal movement of the second axle with respect to the frame element; means for adjusting an angular position of at least one of the first wheelset and the second wheelset with respect to the frame element to adjust the angular position thereof; the angular adjusting means comprising: shaft means, for being disposed longitudinally along the railroad car, being connected with the at least one of the first wheelset and the second wheelset to pivotally displace the at least one of the first wheelset and the second wheelset; means for longitudinally displacing the shaft means to pivotally displace the at least one of the first wheelset and the second wheelset; and means for restraining the pivotal movement of the at least one of the first wheelset and the second wheelset in the longitudinal direction of the railroad car by counteracting the longitudinally directed force provided by the longitudinal displacement of the shaft means.

Another aspect of the invention resides broadly in a method of operating a railroad bogie on a railroad car, the railroad car having a frame and defining a longitudinal direction, the method comprising the steps of: providing a frame element; providing means for pivotally connecting the frame element to the frame of the railroad car; providing a first wheelset and mounting the first wheelset on the frame element, the first wheelset comprising a first axle, the first axle comprising opposite ends, the first wheelset comprising a pair of wheels being mounted at the opposite ends of the first axle; providing a second wheelset and mounting the second wheelset on the frame element, the second wheelset comprising a second axle, the second axle comprising opposite ends, the second wheelset comprising a pair of wheels being mounted at the opposite ends of the second axle; providing means for permitting pivotal movement of the first axle with respect to the frame element; providing means for permitting pivotal movement of the second axle with respect to the frame element; providing means for adjusting an angular position of at least one of the first wheelset and the second wheelset with respect to the frame element; the step of providing the angular adjusting means comprising the step of providing means for applying a longitudinally directed force to pivotally displace the at least one of the first wheelset and the second wheelset to adjust the angular position thereof; providing means for sensing an angular position of the frame element with respect to the frame of the railroad car; providing means for determining a revised angular position of the at least one of the first wheelset and the second wheelset with respect to the frame element based on the angular position of the frame element with respect to the frame of the railroad car; sensing an angular position of the frame element with respect to the frame of the railroad car; determining a revised angular position of the at least one of the first wheelset and the second wheelset with respect to the frame element based on the angular position of the frame element with respect to the frame of the railroad car; and adjusting the angular adjusting means to pivotally displace the at least one of the first wheelset and the second wheelset into the revised angular position.

Yet another aspect of the invention resides broadly in a method of operating a railroad car, the method comprising the steps of: providing a railroad car, the railroad car having a frame and defining a longitudinal direction; providing a first bogie and a second bogie, each of the first bogie and the second bogie comprising a frame element, each of the first bogie and the second bogie comprising a first wheelset and a second wheelset; providing means for pivotally connecting the frame element of the first bogie to the frame of the railroad car and means for pivotally connecting the frame element of the second bogie to the railroad car; pivotally connecting the frame element of the first bogie to the railroad car and pivotally connecting the frame element of the second bogie to the railroad car; providing first means for sensing an angular position of the frame element of the first bogie with respect to the frame of the railroad car; providing second means for sensing an angular position of the frame element of the second bogie with respect to the frame of the railroad car; providing means for determining a revised angular position of at least a portion of at least one of the first bogie and the second bogie with respect to the frame of the railroad car based on: the angular position of the frame element of the first bogie with respect to the frame of the railroad car; and the angular position of the frame element of the second bogie with respect to the frame of the railroad car; providing means for adjusting the angular position of at least a portion of at least one of the first bogie and the second bogie with respect to the frame of the railroad car to adjust the at least a portion of at least one of the first bogie and the second bogie to the revised angular position determined for each of the first bogie and the second bogie; sensing an angular position of the frame element of the first bogie with respect to the frame of the railroad car with the first sensing means; sensing an angular position of the frame element of the second bogie with respect to the frame of the railroad car with the second sensing means; determining a revised angular position of at least a portion of at least one of the first bogie and the second bogie with respect to the frame of the railroad car based on: the sensed angular position of the frame element of the first bogie with respect to the frame of the railroad car; and the sensed angular position of the frame element of the second bogie with respect to the frame of the railroad car; and adjusting the angular position of at least a portion of at least one of the first bogie and the second bogie with respect to the frame of the railroad car to adjust the at least a portion of at least one of the first bogie and the second bogie to the revised angular position determined for each of the first bogie and the second bogie.

BRIEF DESCRIPTION OF THE DRAWINGS

The accompanying drawings are schematic illustrations of embodiments of the invention, wherein.

DESCRIPTION OF THE PREFERRED EMBODIMENTS

Figure 1:
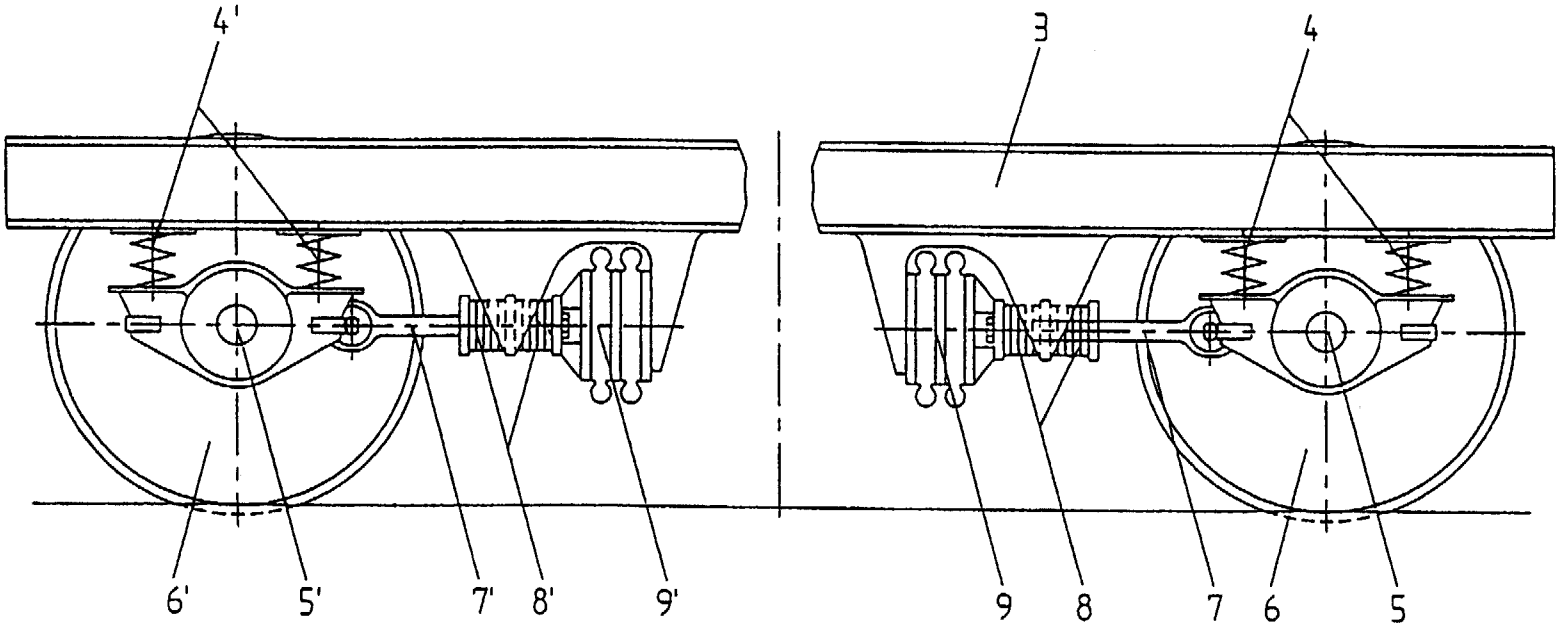
FIG. 1 is a side view of an undercarriage with force-controlled actuators for radial adjustment.

In the configuration illustrated in FIG. 1, the two end wheelsets of a truck are shown with a leading end wheelset 6 and a trailing end wheelset 6'. The corresponding intermediate wheelsets are not shown in any greater detail.

Thus, essentially, in FIG. 1, only one wheel wheelset is shown from each of two trucks. Wheelset 6 represents a leading end wheelset of a leading truck and wheelset 6' represents a trailing end wheelset of a trailing truck. Thus, the trailing end wheel set of the leading truck and the leading end wheelset of the trailing truck are not shown in FIG. 1.

The wheelsets 6, 6' are each mounted in wheelset bearings 5, 5', whereby two coil springs 4, 4' preferably transmit lateral loads from the truck frame 3 to the wheelset 6, 6'. In the longitudinal direction, the wheelsets 6, 6' are preferably guided by means of a longitudinal control element 7, 7' and an assembly of mutually opposing springs 8, 8'. Also engaged with the longitudinal control elements 7, 7', parallel to the spring assembly 8, 8' is a force-controlled actuator 9, 9'. In the illustrated embodiment, bellows cylinders are used in the capacity of force-controlled actuators 9, 9'.

Thus, in accordance with a preferred embodiment of the present invention, bellows-type cylinders, as illustrated, may be used as force-controlled actuators 9, 9'. Additionally, a pair of mutually opposing springs may be provided for each wheelset 6, 6'in question, referred to in FIG. 1, respectively as pair 8 and pair 8'. Thus, within each pair of mutually opposing springs 8, 8', there is preferably a first spring and a second spring, which first and second springs are preferably disposed against each other.

When the vehicle is travelling on a straight section of track, all the actuators 9, 9', preferably in the form of bellows cylinders, are preferably unpressurized, and therefore exert essentially no force on corresponding wheelsets 6, 6'. When the vehicle negotiates curves, preferably only the actuators 9, 9' corresponding to wheels on the outside of the curve are pressurized with compressed air, so that a force can be generated which spreads, or moves, one of the two end wheelsets 6, 6', and causes the wheelsets 6, 6' to make a radial adjustment. As a result of the variation of the pressure, the force and thus the angle between the wheelsets 6, 6' and the truck frame 3 can be adjusted to the radius of the curve.

Instead of the bellows cylinders, of course, other force-controlled actuators 9, 9' can also be used, such as pneumatic cylinders. Since these elements can exert both traction and compression forces, it is possible to locate the actuators 9, 9' either only on one side of the wheelsets 6, 6' or to connect the actuators 9, 9' so that the ones located on the outside of the curve exert a spreading force, and the ones located on the inside of the curve exert a contraction force of one-half the value. An example of such a configuration may be seen in FIG. 6.

Figure 2:
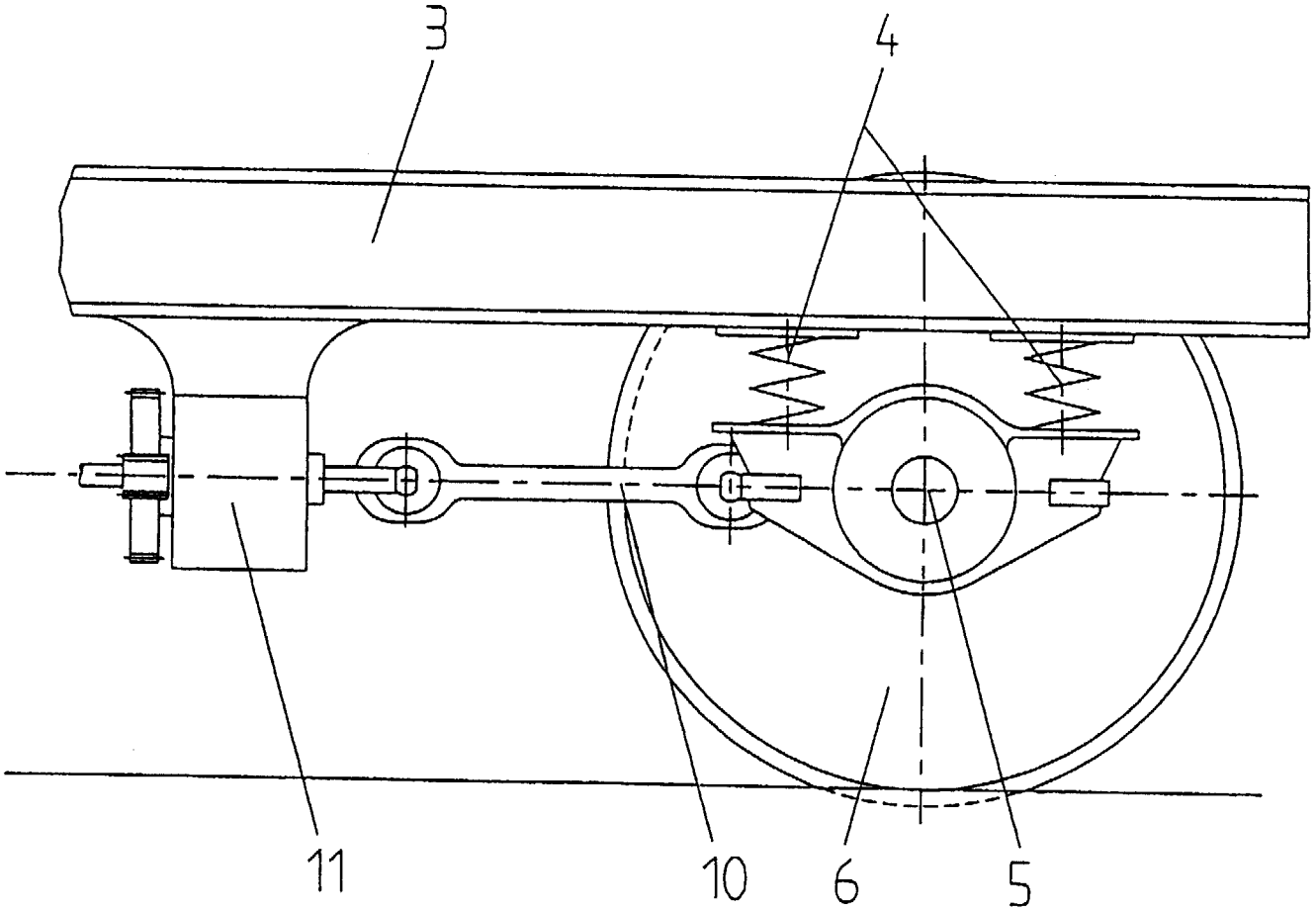
FIG. 2 is a side view of an undercarriage with displacement-controlled actuators for radial adjustment.

In accordance with another preferred embodiment of the present invention, FIG. 2 illustrates an undercarriage with radial control by means of a displacement-controlled actuator 11. The wheelset 6 can preferably be guided as illustrated in FIG. 1. The function of the spring assembly 8, 8' is preferably performed by spherical bearings on the ends of the longitudinal control arms 10.

In other words, in accordance with the embodiment illustrated in FIG. 1, a displacement-controlled actuator 11 can preferably be used to provide radial control with an end result similar to the radial control provided by force-controlled actuators 9, 9', as discussed hereinabove. In this respect, the wheelset 6 illustrated in FIG. 2 may preferably be guided in a manner similar to that described with respect to the embodiment of FIG. 1.

Figure 2A:
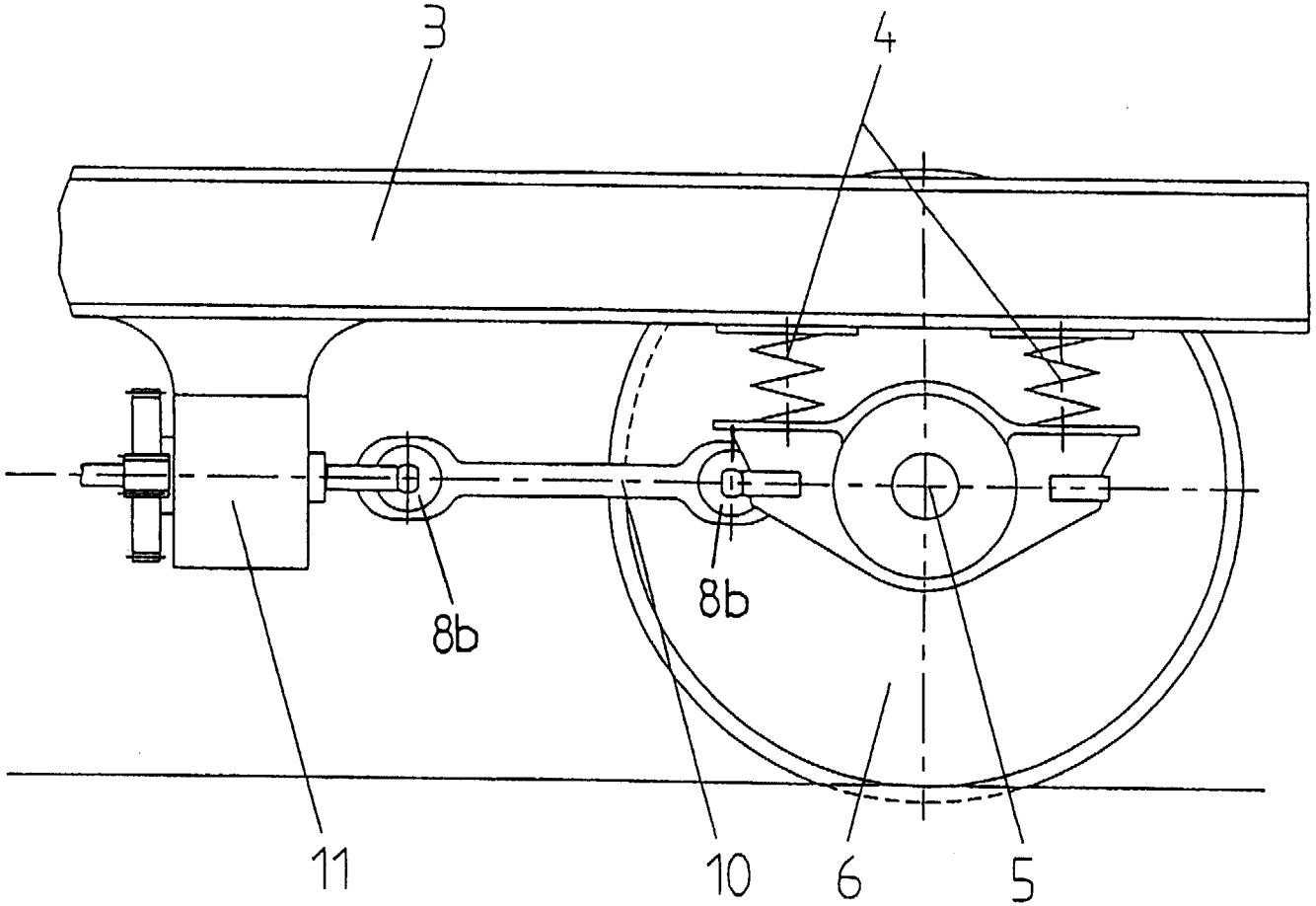
FIG. 2*a* is substantially the same view as FIG. 3, but more detailed.

FIG. 2*a* is substantially the same view as FIG. 2, but additionally indicates the aforementioned spherical bearings at reference numeral 8*b*. Preferably, spherical bearings 8*b* perform a function similar to that of spring assembly 8, 8'. In this respect, spherical bearings 8*b* are preferably configured as rubber or elastomeric spherical bearings and preferably provide a restraining force when wheelset 6 undergoes pivotal displacement with respect to truck 3.

Figure 3:
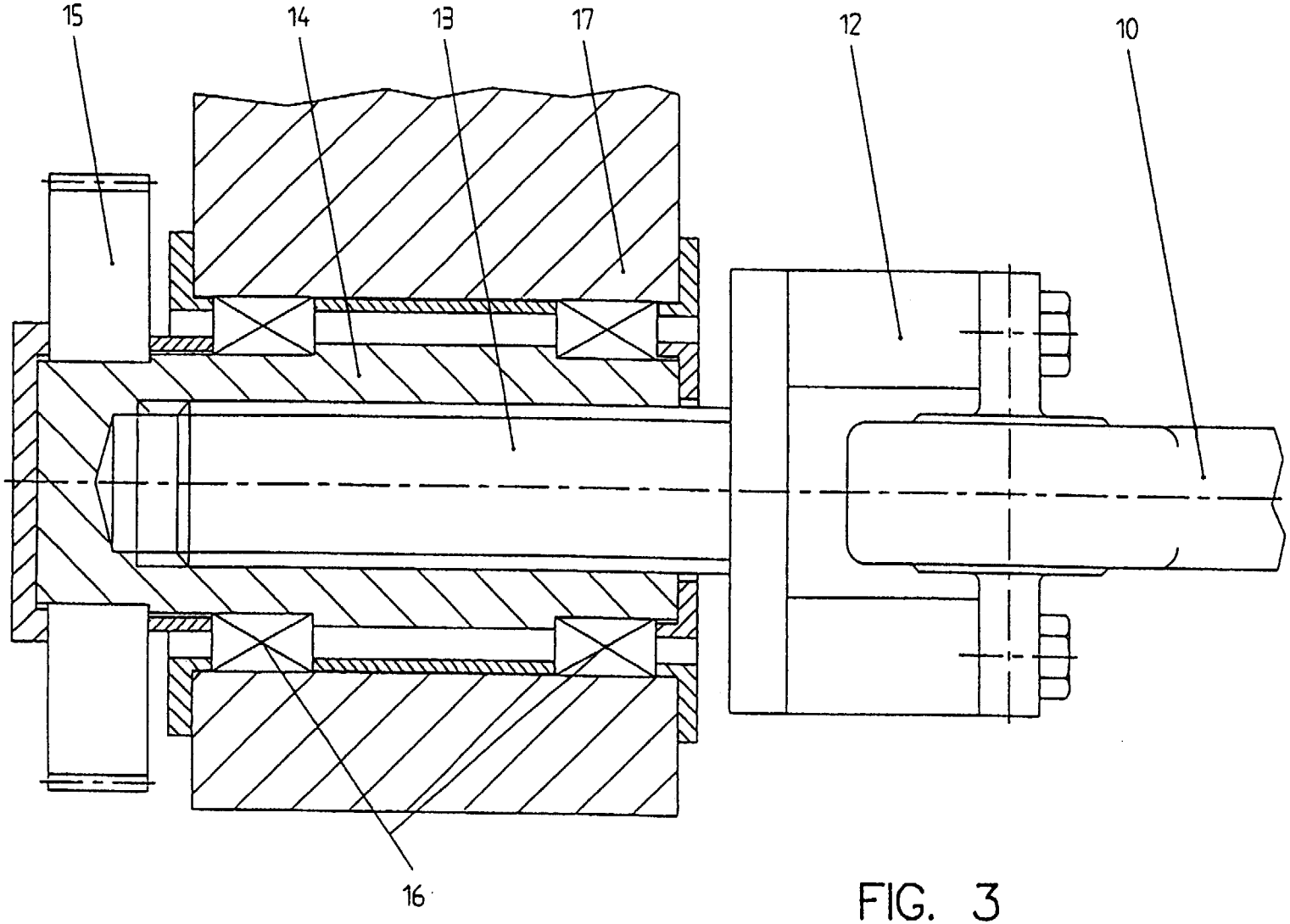
FIG. 3 is a detailed view of a displacement-controlled actuator as illustrated in FIG. 2.

FIG. 3 illustrates a displacement-controlled actuator in the form of a mechanical control device. In this embodiment, the longitudinal control arm 10 can preferably be connected to a screw drive mechanism 13 by means of the spherical bearing and two claws 12, whereby the bearings 16 between a spindle nut 14 and a fastening block 17 essentially guarantee that the spindle nut 14 can rotate freely around its axis, but is stationary in the axial direction, and thus absorbs the longitudinal forces of the wheelset 6 (not shown). The rotational movement of the spindle nut 14 is essentially converted into an axial movement of the spindle 13 and of the spherical bearing by the drive of the spindle nut 14 by means of a gear wheel 15 and a control motor (not shown). Naturally, hydraulic cylinders can also be used instead of a mechanical adjustment device. Pneumatic cylinders may also be employed instead of a mechanical adjustment device.

Figure 4:
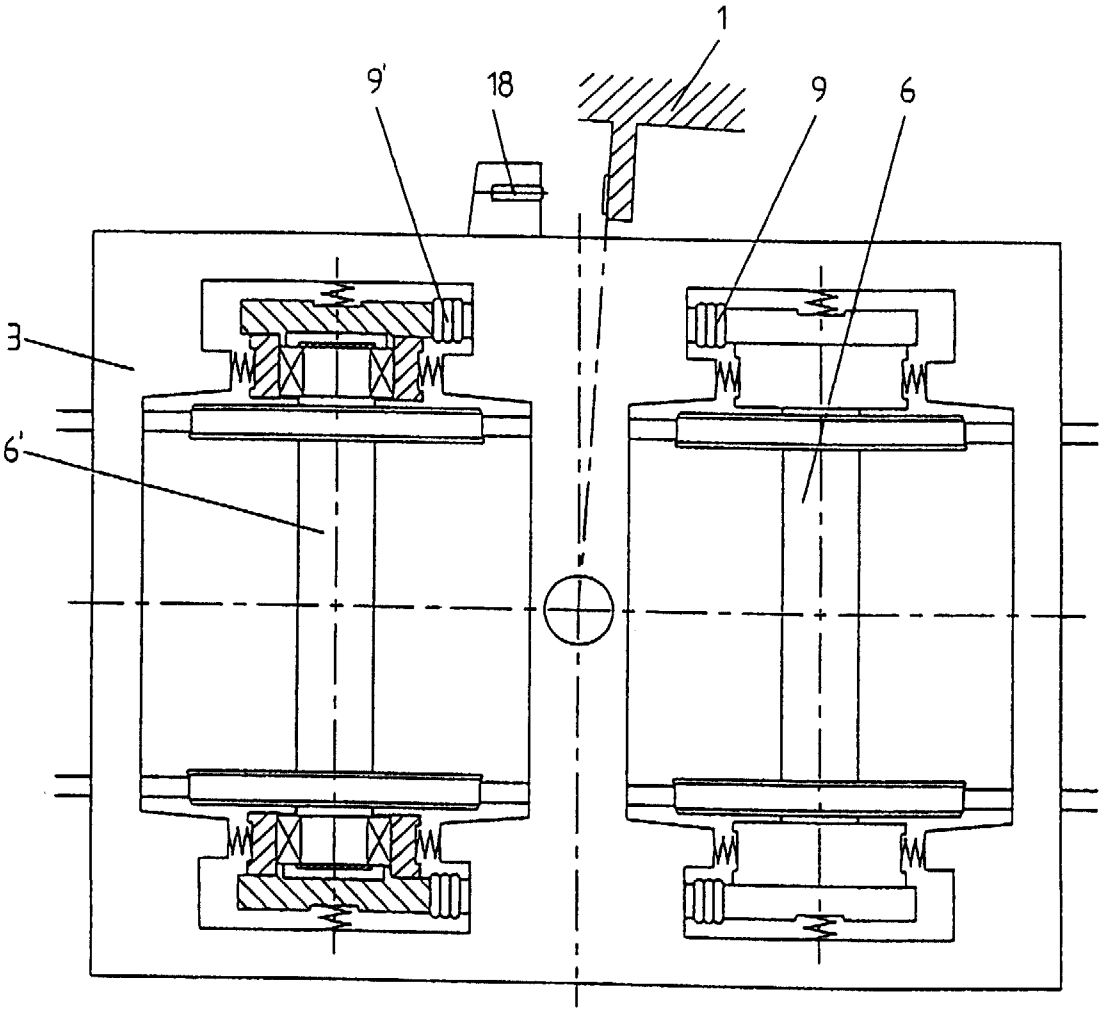
FIG. 4 shows the installation of a sensor between the truck frame and the vehicle frame.

FIG. 4 is a schematic illustration of the installation of a sensor 18 to control the actuators 9, 9'; 11. The angle of rotation between the truck frame 3 and the vehicle frame 1 can preferably be determined from a measurement of the distance between the sensor 18 and a measurement surface on the vehicle frame 1.

The angular measurement is most efficiently taken in the longitudinal direction, since the mobility between the truck frame and the vehicle frame in the longitudinal direction is generally less than in the lateral direction.

Figure 4A:
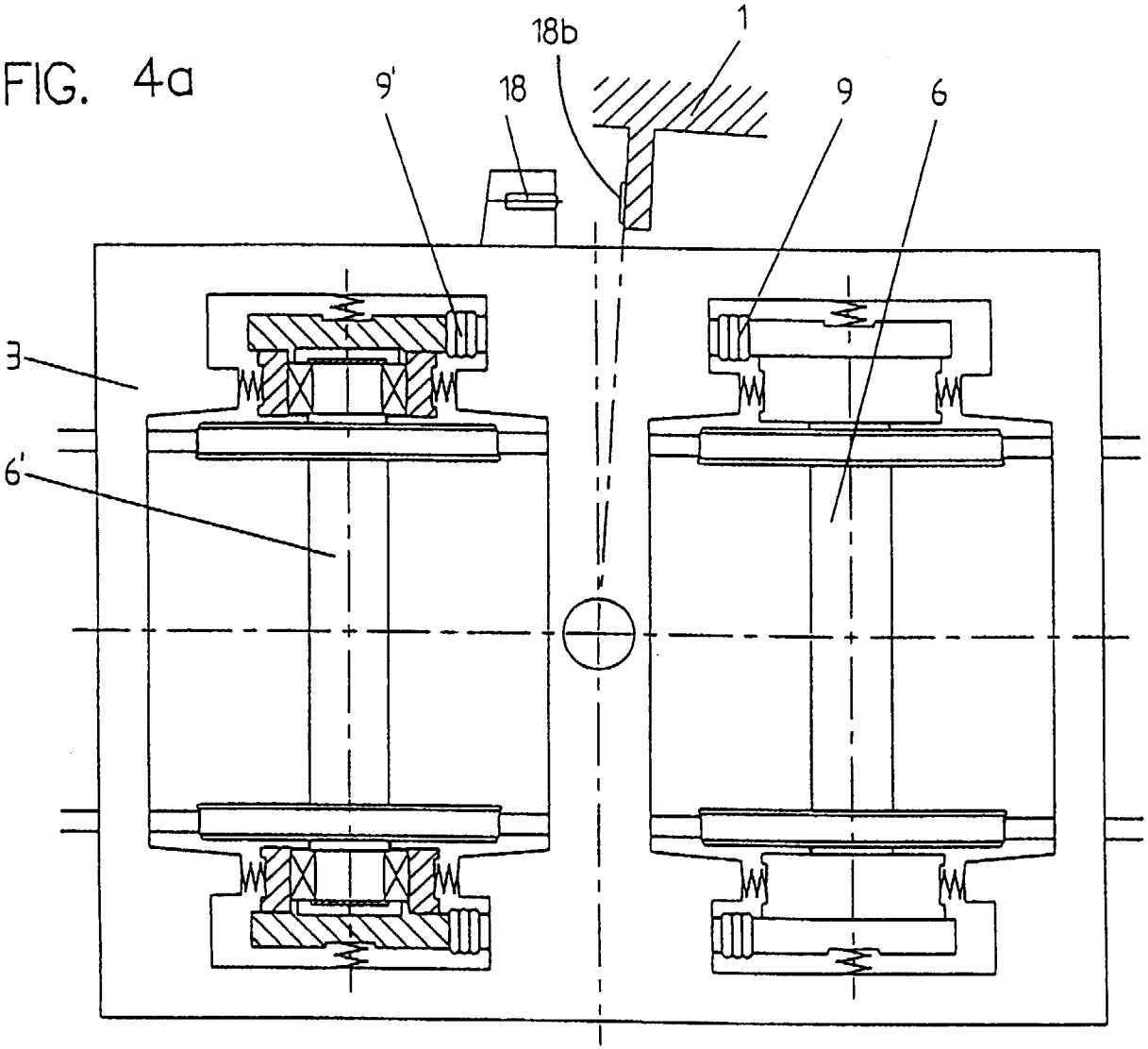
FIG. 4*a* is substantially the same view as FIG. 4, but more detailed.

FIG. 4*a* is substantially the same view as FIG. 4, but additionally indicates the aforementioned measurement surface at reference numeral 18*b*. Preferably, the sensor 18 may be an optical sensor for measuring the longitudinal distance between sensor 18 and measurement surface 18*b*. The sensed distance may then preferably be calculated with respect to the angular displacement of the truck 3 with respect to the vehicle frame 1.

Of course, it is conceivable, within the scope of the present invention, to provide other types of sensor mechanisms. For example, it is conceivable to employ a sensor mechanism mounted in the vicinity of the pivoting connection between vehicle frame 1 with truck 3, 3', so that the rotational displacement of truck 3, 3'with respect to vehicle frame 1 can be measured directly. Such a shaft mounted sensor mechanism may include, for example, a magnetic sensor, a capacitive sensor or an optical sensor.

Figure 5:
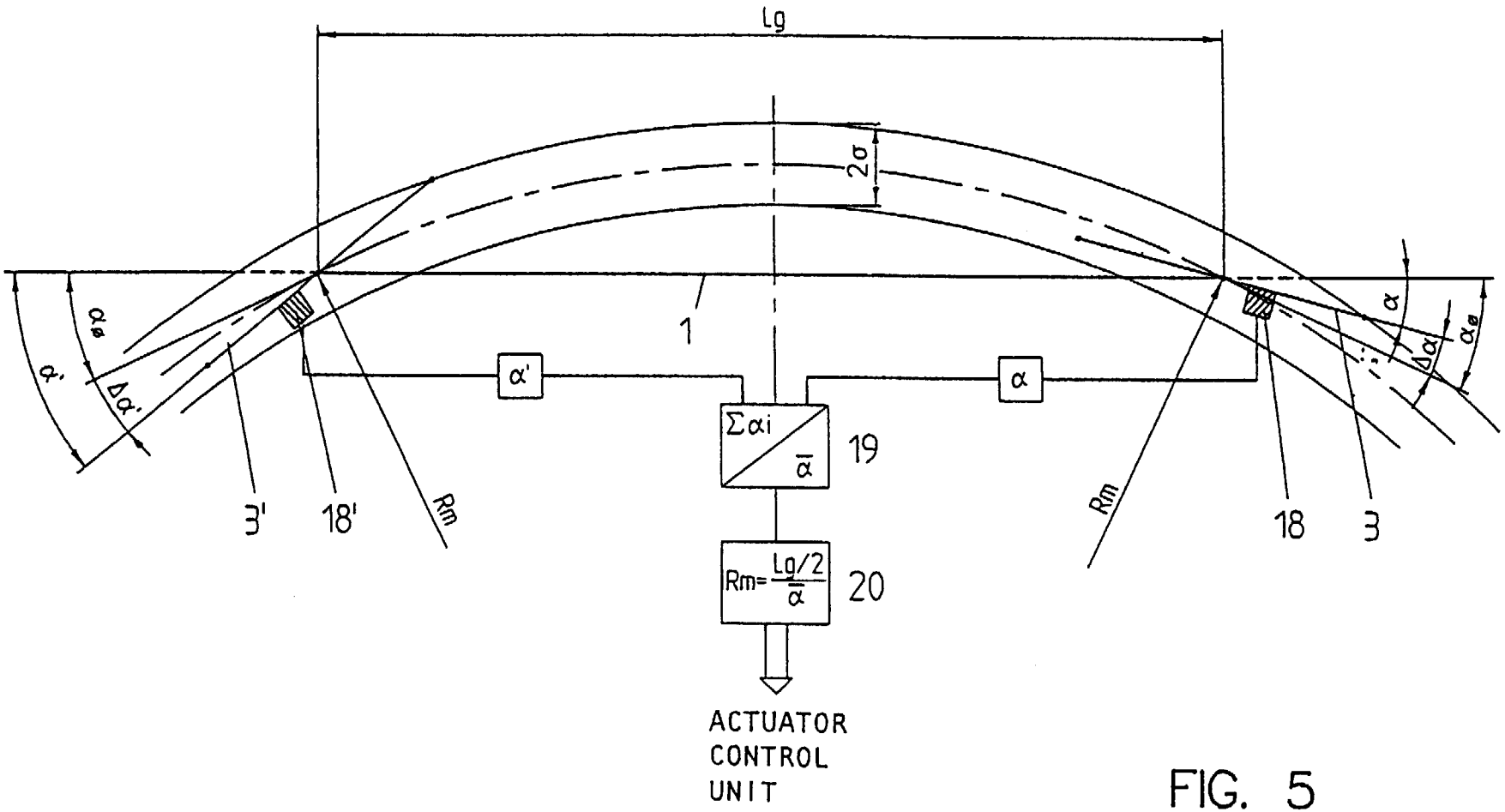
FIG. 5 shows an array of sensors on end trucks and the processing of the measurement signals.

FIG. 5 shows a system of two trucks with sensors 18, 18' and a logic connection of the two measurement signals by means of a railway vehicle in the gauge channel of the railway.

The respective angle of rotation ($\alpha$, $\alpha'$) of each truck 3, 3' in relation to the vehicle frame 1 is preferably measured by the sensor 18 on the leading truck 3 and by the sensor 18' on the trailing truck 3'.

On account of the inclination inside the gauge channel and within the lateral suspension, the two angles $\alpha$ and $\alpha'$ may differ from the angle ($\alpha\phi$), which for radially-oriented trucks is:

$$\alpha\phi = \frac{lg/2}{Rm}$$

where lg is the center-to-center distance between trucks and Rm is the average curve radius It is apparent that the angle of rotation of the leading truck is somewhat less than $\alpha\phi$ $$\alpha = \alpha\phi - \Delta\alpha$$

and the angle of rotation of the trailing truck is somewhat greater $$\alpha' = \alpha\phi + \Delta\alpha'$$

Because $\Delta\alpha$ and $\Delta\alpha'$ are approximately the same, a very precise yardstick for the radius Rm of the curve being negotiated can be derived from the sum and/or the average of the two angles:

$$\alpha = \frac{\alpha + \alpha'}{2} \approx \alpha\phi = \frac{lg/2}{Rm}$$

FIG. 5 also shows the processing of the sensor output signals. By summation or averaging (19), the two measurement signals can preferably be combined into a single value $\alpha$ and converted into the curve radius Rm (20). This processed value is now available as the set-point value in the control circuit of the actuators 9, 9'; 11. Essentially, the only other factors which need to be taken into consideration are the wheelbases and the rigidities which oppose the rotation of the wheelset in relation to the truck frame.

Figure 5A:
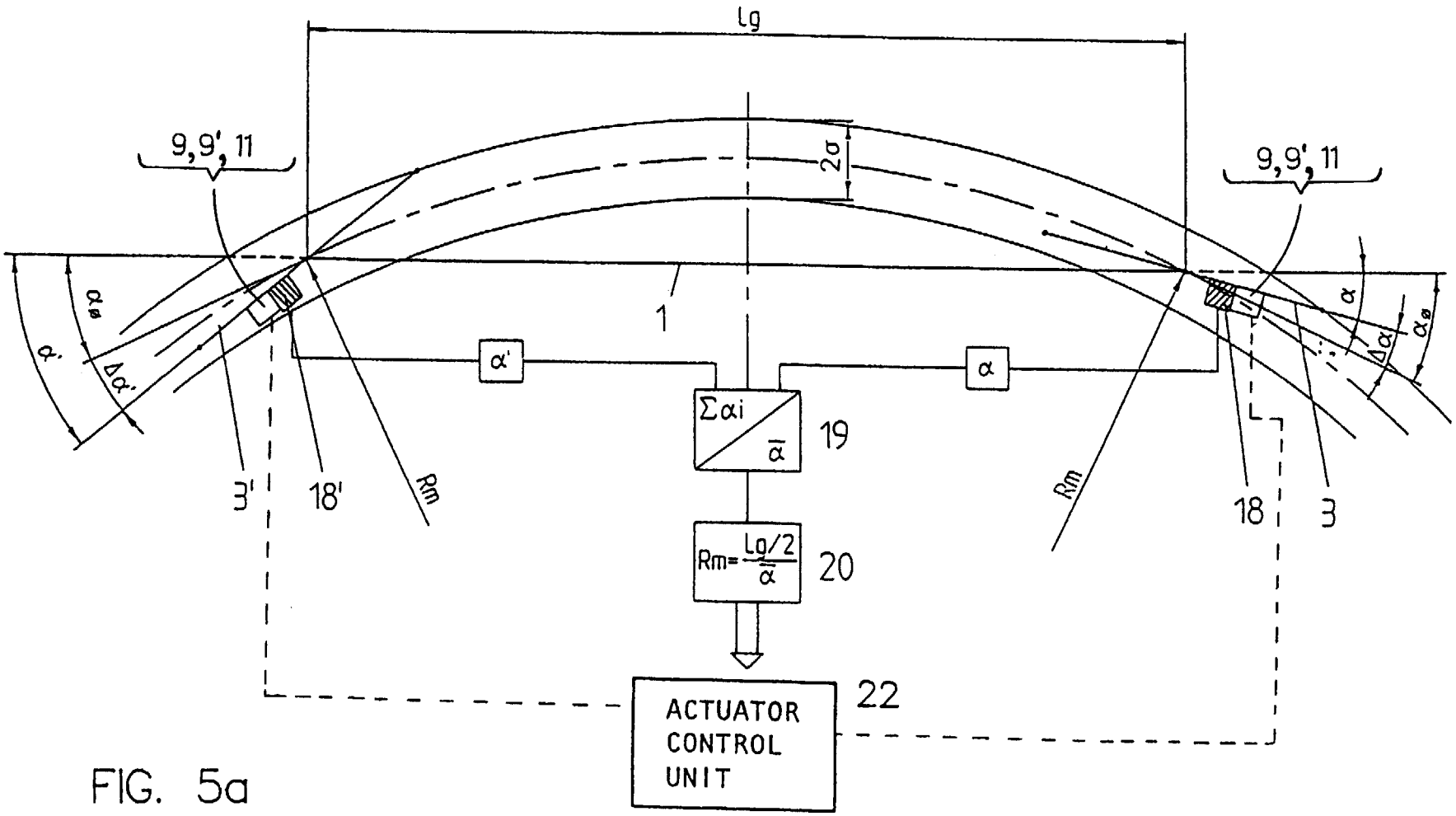
FIG. 5*a* is substantially the same view as FIG. 5, but illustrates additional components.

FIG. 5*a* schematically illustrates a control system which may be employed in accordance with the present invention. Preferably, the determined value (20) for the curve radius Rm is fed into an actuator control unit 22. Preferably, the actuator control unit 22 controls the actuators 9, 9' or 11 such that the actuator in question will provide the appropriate longitudinal displacement of shaft 7, 7' or 10, as discussed previously, to pivotally displace the desired wheelset or wheelsets 6, 6' to result in the desired curve radius Rm. In one preferred embodiment of the present invention, only one wheelset from each truck 3, 3' is controlled in this manner, preferably the leading wheelset of the leading truck and the trailing wheelset of the trailing truck. In accordance with another preferred embodiment of the present invention, both wheelsets 6, 6' of both trucks 3, 3'can be controlled in the manner just described. It is also conceivable, within the scope of the present invention, to provide separate control systems for the leading truck and the trailing truck, and to provide a system which would calculate an appropriate curve radius for each of the leading truck and the trailing truck, based, respectively, on the angular displacement of each of the leading truck and the trailing truck with respect to the vehicle frame 1.

Figure 6:
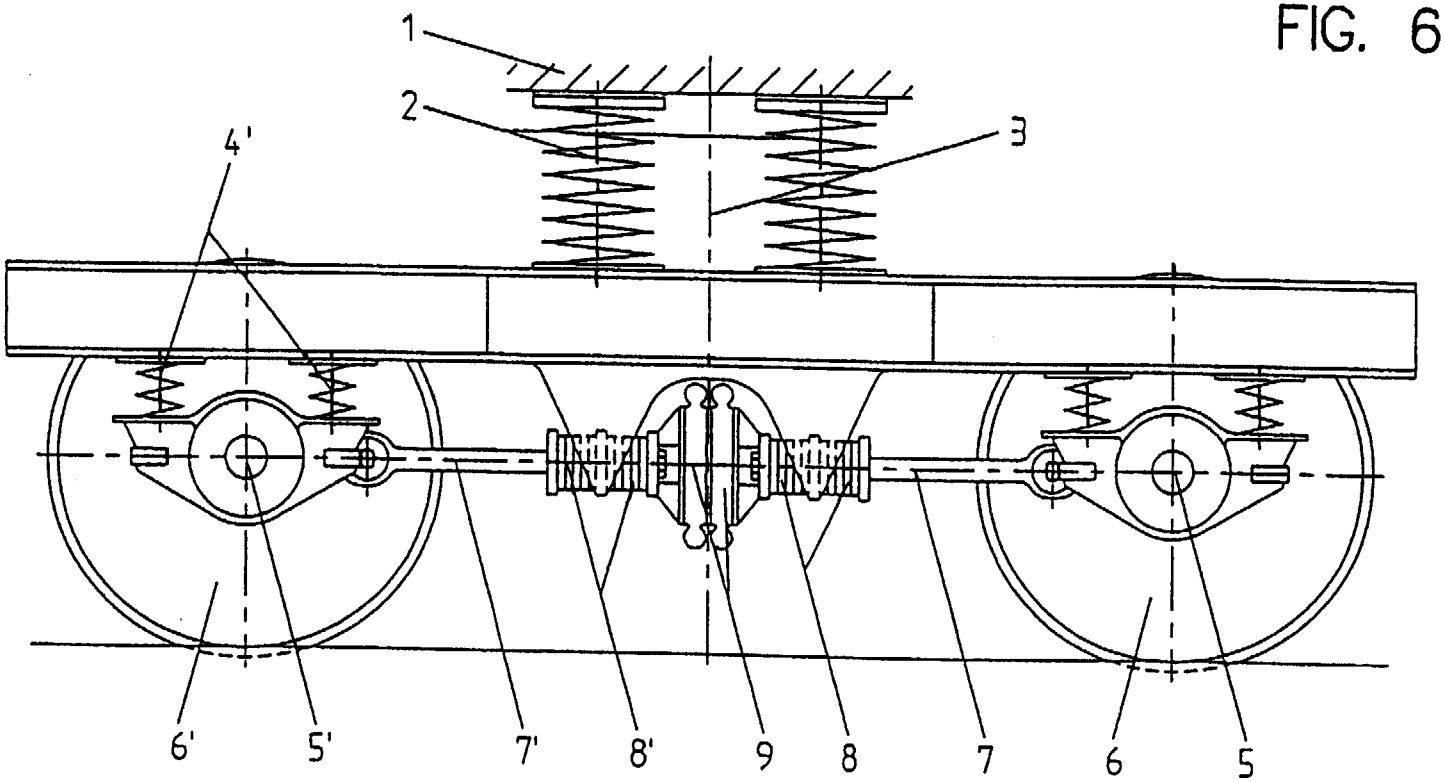
FIG. 6 is a side view of a two-axle truck with a combination actuator for both wheelsets, as a force-controlled actuator.

As shown in FIG. 6, on a two-axle trucks without an excessively large wheelbase, it is possible to combine the force-controlled actuators 9, 9' of the leading wheelset and of the trailing wheelset 6, 6' into a single actuator, designated as 9. A similar arrangement can also be realized for displacement-controlled actuators 11. As discussed further above, the actuation of the actuator 9, 9' or 11 in question may be accomplished by providing a spreading force or a contraction force, whichever is appropriate.

With reference to FIGS. 1 and 6, it should be understood that each set 8, 8' of opposing springs may preferably be configured such that one spring is acting when the corresponding wheel is on the inside of a track curve and that the other spring is acting when the corresponding wheel is on the outside of a track curve. Such a configuration may be embodied by allowing bellows 9, 9' to be connected to at least a portion of the corresponding shaft 7, 7' by means of a through connection through the set 8, 8' of springs. Additionally, there may preferably be a disc separating the two opposing springs in each set of springs 8, 8', which disc may preferably be mounted on the frame of truck 3. The springs 8, 8' and the corresponding shaft 7, 7' may thus preferably be configured such that, when shaft 7, 7' is displaced generally away from bellows 9, 9', the spring closer to bellows 9, 9' is compressed against the aforementioned disc while, when shaft 7, 7' is displaced generally towards bellows 9, 9', the spring further away from bellows 9, 9' is compressed against the aforementioned disc.

It should be understood that various components, as disclosed with relation to various embodiments, can conceivably be interchangeable with components relating to different embodiments. For example, it is conceivable that the bellows 9, 9' shown in FIG. 1 could be interchanged with the actuator 11 shown in FIG. 2 and that the sets of opposing springs 8, 8' shown in FIG. 1 could be interchanged with the spherical bearings 8*b* shown in FIG. 2.

One feature of the invention resides broadly in the undercarriage for railway vehicles with at least four wheelsets and with at least each two wheelsets combined into a truck and connected to a truck frame by means of coupling and guide elements, and in which the truck frame is configured so that it can pivot in relation to a vehicle frame, characterized by the fact that connected to the end wheelsets 6, 6' of the truck are force-controlled actuators 9, 9', such as bellows cylinders, which act on the wheelset bearings 5, 5' for the radial rotation of the wheelset 6, 6' in relation to the truck frame 3, and that the actuators 9, 9' are oriented parallel to longitudinal control arms 7, 7' with an assembly of mutually-opposing springs 8, 8' for the longitudinal restraint of the wheelset.

Another feature of the invention resides broadly in the undercarriage for railway vehicles with at least four wheelsets and with at least each two wheelsets combined into a truck and connected to a truck frame by means of coupling and guide elements, and in which the truck frame is configured so that it can pivot in relation to a vehicle frame, characterized by the fact that connected to the end wheelsets 6, 6' of the truck are displacement-controlled actuators 9, 9' such as control motors, to control a spindle 13 by means of a driven nut 14, which act on the wheelset bearings 5, 5' for the radial rotation of the wheelset 6, 6' in relation to the truck frame 3, and that the actuators 11 are connected in series with longitudinal control arms 10 for the longitudinal restraint of the wheelset.

Yet another feature of the invention resides broadly in the undercarriage, characterized by the fact that a sensor 18 is installed as the measurement element between the vehicle frame 1 and the truck frame 3, and the actuators 9, 9'; 11 can be adjusted as a function of the angle of rotation measured by the sensor 18.

Still another feature of the invention resides broadly in the undercarriage, characterized by the fact that a sensor 18, 18' is located on each truck frame 3, and the actuators 9, 9'; 11 can be adjusted jointly by means of a control device as a function of the average of the two angles of rotation.

Several components described herein are disclosed in various U.S. Patents. Particularly, examples of spherical bearings, which may be utilized in accordance with the embodiments of the present invention, may be found in the following U.S. Pat. Nos. 5,215,502, which issued to Neathery et al. on Jun. 1, 1993; 4,614,455, which issued to Skipper on Sep. 30, 1986; and 4,447,072, which issued to Bradley et al. on May 8, 1984.

Examples of arrangements of opposing springs, which may be utilized in accordance with the embodiments of the present invention, may be found in the following U.S. Pat. Nos. 5,193,661, which issued to Foster on Mar. 16, 1993; 4,597,483, which issued to Porel et al. on Jul. 1, 1986; and 4,450,752, which issued to Donovan on May 29, 1984.

Examples of actuator arrangements, such as bellows arrangements, pneumatic cylinder arrangements, and hydraulic cylinder arrangements, which may be utilized in accordance with the embodiments of the present invention, may be found in the following U.S. Pat. Nos. 5,141,412, which issued to Meinz on Aug. 25, 1992; 5,095,680, which issued to Guardiola on Mar. 17, 1992; 4,577,821, which issued to Edmo et al. on Mar. 25, 1986; and 4,225,281, which issued to Bibeau et al. on Sep. 30, 1980.

Examples of optical distance sensors, which may be utilized in accordance with the embodiments of the present invention, may be found in the following U.S. Pat. Nos. 5,151,608, which issued to Torii et al. on Sep. 29, 1992; 5,025,147, which issued to Durig et al. on Jun. 18, 1991; and 4,970,384, which issued to Kambe et al. on Nov. 13, 1990.

Examples of shaft-mounted sensors, which may be utilized in accordance with the embodiments of the present invention, may be found in the following U.S. Pat. Nos. 5,239,623, which issued to Iwata et al. on Aug. 24, 1993; 5,148,106, which issued to Ozawa on Sep. 15, 1992; 4,932,388, which issued to Chiba et al. on Jun. 12, 1990; and 4,931,636, which issued to Huggins on Jun. 5, 1990.

Examples of control systems, which may be utilized in accordance with the embodiments of the present invention, may be found in the following U.S. Pat. Nos. 4,989,148, which issued to Gürke et al. on Jan. 29, 1991; 4,638,670, which issued to Moser on Jan. 27, 1987; 4,563,734, which issued to Mori et al. on Jan. 7, 1986; and 4,558,430, which issued to Mogami et al. on Dec. 10, 1985.

The invention as described hereinabove in the context of the preferred embodiments is not to be taken as limited to all of the provided details thereof, since modifications and variations thereof may be made without departing from the spirit and scope of the invention.

What is claimed is:

1. Method of operating a railroad car, said method comprising the steps of:

providing a railroad car, the railroad car having a frame and defining a longitudinal direction;

providing a first bogie and a second bogie, each of the first bogie and the second bogie comprising a frame element, each of the first bogie and the second bogie comprising a first wheelset and a second wheelset;

providing means for pivotally connecting the frame element of the first bogie to the frame of the railroad car and means for pivotally connecting the frame element of the second bogie to the railroad car;

pivotally connecting the frame element of the first bogie to the railroad car and pivotally connecting the frame element of the second bogie to the railroad car;

providing first means for sensing an angular position of the frame element of the first bogie with respect to the frame of the railroad car;

providing second means for sensing an angular position of the frame element of the second bogie with respect to the frame of the railroad car;

providing means for determining a revised angular position of at least a portion of at least one of the first bogie and the second bogie with respect to the frame of the railroad car based on:

the angular position of the frame element of the first bogie with respect to the frame of the railroad car; and the angular position of the frame element of the second bogie with respect to the frame of the railroad car;

providing means for adjusting the angular position of at least a portion of at least one of the first bogie and the second bogie with respect to the frame of the railroad car to adjust the at least a portion of at least one of the first bogie and the second bogie to the revised angular position determined for each of the first bogie and the second bogie;

sensing an angular position of the frame element of the first bogie with respect to the frame of the railroad car with the first sensing means;

sensing an angular position of the frame element of the second bogie with respect to the frame of the railroad car with the second sensing means;

determining a revised angular position of at least a portion of at least one of the first bogie and the second bogie with respect to the frame of the railroad car based on:

the sensed angular position of the frame element of the first bogie with respect to the frame of the railroad car; and the sensed angular position of the frame element of the second bogie with respect to the frame of the railroad car; and adjusting the angular position of at least a portion of at least one of the first bogie and the second bogie with respect to the frame of the railroad car to adjust the at least a portion of at least one of the first bogie and the second bogie to the revised angular position determined for each of the first bogie and the second bogie.

2. The method according to claim 1, wherein said step of determining a revised angular position comprises the steps of:

determining the average of:

the sensed angular position of the frame element of the first bogie; and the sensed angular position of the frame element of the second bogie; and determining the revised angular position as a function of the determined average angular position.

3. The method according to claim 2, wherein:

said step of providing the first bogie and the second bogie further comprises the following steps for each of the first bogie and the second bogie:

providing, for the first wheelset, a first axle, the first axle comprising opposite ends, and a pair of wheels being mounted at the opposite ends of the first axle;

providing, for the second wheelset, a second axle, the second axle comprising opposite ends, and a pair of wheels being mounted at the opposite ends of the second axle;

providing means for permitting pivotal movement of the first axle with respect to the frame element;

providing means for permitting pivotal movement of the second axle with respect to the frame element; and mounting the first wheelset and the second wheelset on the frame element;

said step of providing the angular adjusting means comprises the following steps for each of the first bogie and the second bogie:

providing means for adjusting an angular position of at least one of the first wheelset and the second wheelset with respect to the frame element;

providing means for applying a longitudinally directed force to pivotally displace the at least one of the first wheelset and the second wheelset;

said step of providing the means for determining a revised angular position further comprises the following step for each of the first bogie and the second bogie:

providing means for determining a revised angular position of the at least one of the first wheelset and the second wheelset with respect to the frame element based on the angular position of the frame element with respect to the frame of the railroad car;

said step of determining a revised angular position comprises the following step for each of the first bogie and the second bogie:

determining a revised angular position of the at least one of the first wheelset and the second wheelset with respect to the frame element based on the angular position of the frame element with respect to the frame of the railroad car; and said step of adjusting the angular adjusting means comprises the following step for each of the first bogie and the second bogie:

adjusting the angular adjusting means to pivotally displace the at least one of the first wheelset and the second wheelset into the revised angular position.

4. The method according to claim 3, wherein, for each of the first bogie and the second bogie:

said step of providing the angular adjusting means further comprises the steps of providing shaft means, disposing the shaft means longitudinally along the railroad car and connecting the shaft means with the at least one of the first wheelset and the second wheelset such that the shaft means is disposed to provide the longitudinally directed force to pivotally displace the at least one of the first wheelset and the second wheelset to adjust the angular position thereof.

5. The method according to claim 4, wherein, for each of the first bogie and the second bogie:

said step of providing the angular adjusting means further comprises the step of providing means for restraining the pivotal movement of the at least one of the first wheelset and the second wheelset in the longitudinal direction of the railroad car by counteracting the longitudinally directed force provided by the longitudinal displacement of the shaft means;

said step of providing means for applying a longitudinally directed force comprises the step of providing means for longitudinally displacing the shaft means to pivotally displace the at least one of the first wheelset and the second wheelset;

said step of providing longitudinal displacing means comprises providing force-controlled actuator means, the force-controlled actuator means being configured for providing a longitudinally directed force to longitudinally displace the shaft means; and said method further comprises the step of configuring each of the first bogie and the second bogie to comprise:

the restraining means comprising spring means, the spring means being configured for providing a counteracting force against the longitudinal displacement of the shaft means in proportion to the longitudinal displacement of the shaft means;

bearing means for bearing the wheels of each of the first wheelset and the second wheelset;

the shaft means comprising multiple shafts, each shaft having a pair of ends;

a first end of each of the shafts being connected with the bearing means of a corresponding one of the first wheelset and the second wheelset;

a second end of each of the shafts being connected with the force-controlled actuator means;

the force-controlled actuator means comprising bellow means;

the bellow means being configured for expanding and contracting pneumatically and for thereby transferring a longitudinally directed force to each of the shafts;

the spring means comprising a pair of mutually opposing springs;

means for sensing an angular position of the frame element with respect to the railroad car;

means for determining a revised angular position of the at least one of the first wheelset and the second wheelset with respect to the frame element based on the angular position of the frame element with respect to the frame of the railroad car;

the angular adjusting means comprising means for pivotally displacing the at least one of the first wheelset and the second wheelset into the revised angular position;

the sensing means being disposed on the truck frame;

the angular adjusting means comprising control means for controlling the force-controlled actuator means;

the bogie further comprises means for transmitting lateral loads from the frame element to the first wheelset and the second wheelset;

the means for transmitting lateral loads comprises a plurality of coil springs connected between the frame element and each of the first wheelset and the second wheelset;

the at least one of the first wheelset and the second wheelset comprises both of the first wheelset and the second wheelset;

the sensing means comprises optical sensing means;

the optical means comprising an optical sensor for sensing a straight-line distance, in the longitudinal direction of the railroad car, between the optical sensor and a measurement surface on the frame of the railroad car; and the means for determining a revised angular position comprising means for converting the measured straight-line distance to the angular position of the frame element with respect to the frame of the railroad car.

6. The method according to claim 4, wherein, for each of the first bogie and the second bogie:

said step of providing the angular adjusting means further comprises the step of providing means for restraining the pivotal movement of the at least one of the first wheelset and the second wheelset in the longitudinal direction of the railroad car by counteracting the longitudinally directed force provided by the longitudinal displacement of the shaft means;

said step of providing means for applying a longitudinally directed force comprises the step of providing means for longitudinally displacing the shaft means to pivotally displace the at least one of the first wheelset and the second wheelset; and said step of providing the longitudinal displacing means comprises the step of providing displacement-controlled actuator means, the displacement-controlled actuator means comprising spindle means and means for displacing the spindle means, the spindle means being configured for longitudinally displacing the shaft means; and said method further comprises the step of configuring each of the first bogie and the second bogie to comprise:

the restraining means comprising spring means, the spring means being configured for providing a counteracting force against the longitudinal displacement of the shaft means in proportion to the longitudinal displacement of the shaft means.

bearing means for bearing the wheels of each of the first wheelset and the second wheelset;

the shaft means comprising multiple shafts, each of the shafts having a pair of ends;

a first end of each of the shafts being connected with the bearing means of a corresponding one of the first wheelset and the second wheelset;

a second end of each of the shafts being connected with the displacement-controlled actuator means;

the spindle means comprising multiple spindles;

the displacement-controlled actuator means comprising means for displacing the spindles;

each spindle being configured for undergoing longitudinal displacement to transfer a longitudinally directed force to a corresponding one of the shafts;

the spring means comprising pairs of spherical bearings;

a first spherical bearing of each pair of spherical bearings being connected with the first end of a corresponding one of the shafts;

a second spherical bearing of each pair of spherical bearings being connected with the second end of a corresponding one of the shafts;

means for sensing an angular position of the frame element with respect to the railroad car;

means for determining a revised angular position of the at least one of the first wheelset and the second wheelset with respect to the frame element based on the angular position of the frame element with respect to the frame of the railroad car;

the angular adjusting means comprising means for pivotally displacing the at least one of the first wheelset and the second wheelset into the revised angular position;

the sensing means being disposed on the truck frame;

the angular adjusting means comprising control means for controlling the displacement-controlled actuator means;

each spindle comprises a spindle body, a spindle nut being threadedly engaged with the spindle body, and a fastening block housing the spindle nut;

each spindle nut is rotatably mounted, and axially fixed, within its corresponding fastening block;

each spindle has an extended end away from its corresponding fastening block;

the second spherical bearing of each pair of spherical bearings is connected between the second end of each of the shafts and the extended end of the corresponding spindle;

the bogie further comprises means for transmitting lateral loads from the frame element to the first wheelset and the second wheelset;

the means for transmitting lateral loads comprises a plurality of coil springs connected between the frame element and each of the first wheelset and the second wheelset;

the at least one of the first wheelset and the second wheelset comprises both of the first wheelset and the second wheelset;

the sensing means comprises optical sensing means;

the optical means comprising an optical sensor for sensing a straight-line distance, in the longitudinal direction of the railroad car, between the optical sensor and a measurement surface on the frame of the railroad car; and the means for determining a revised angular position comprising means for converting the measured straight-line distance to the angular position of the frame element with respect to the frame of the railroad car.

* * * * *

UNITED STATES PATENT AND TRADEMARK OFFICE

CERTIFICATE OF CORRECTION

PATENT NO. : 5,429,056

DATED : July 4, 1995

INVENTOR(S) : Ernst PEES and Hans-Dieter SCHALLER

It is certified that error appears in the above-indentified patent and that said Letters Patent is hereby corrected as shown below:

In column 2, line 7, after 'vehicle', delete "frees" and insert --frames--.

Signed and Sealed this

Thirty-first Day of December, 1996

*Attest:*

*Attesting Officer*

BRUCE LEHMAN

*Commissioner of Patents and Trademarks*